US005555563A

United States Patent [19]

Ear

[11] Patent Number: 5,555,563

[45] Date of Patent: Sep. 17, 1996

[54] NECKTIE

[76] Inventor: Richard E. Ear, 13419 Pocono Ct., Herndon, Va. 22070

[21] Appl. No.: 478,775

[22] Filed: Jun. 7, 1995

[51] Int. Cl.[6] ..... A41D 25/00; A41D 25/02; A41D 25/16

[52] U.S. Cl. ..... 2/148; 2/149; 2/150; 2/152.1; 2/153

[58] Field of Search ..... 2/144, 145, 146, 2/147, 148, 149, 150, 151, 152.1, 153, 154, 155, 156, 157

[56] References Cited

U.S. PATENT DOCUMENTS

| | | |
|---|---|---|
| 3,898,698 | 8/1975 | Byrd . |
| 4,513,453 | 4/1985 | Chen et al. . |
| 4,656,672 | 4/1987 | Lande . |
| 4,710,982 | 12/1987 | Lande . |
| 4,835,794 | 6/1989 | Chen et al. . |
| 5,048,127 | 9/1991 | Yang . |
| 5,113,531 | 5/1992 | Castro . |
| 5,170,507 | 12/1992 | Langford . |
| 5,390,370 | 2/1995 | Koy ..... 2/150 |
| 5,416,926 | 5/1995 | Koy ..... 2/150 X |

FOREIGN PATENT DOCUMENTS

| | | |
|---|---|---|
| 1178162 | 5/1959 | France . |

*Primary Examiner*—Jeanette E. Chapman
*Attorney, Agent, or Firm*—Richard C. Litman

[57] ABSTRACT

A prefabricated necktie including a frame having a generally wedge-shaped front profile and including flanges extending rearwardly and tapering downwardly. The operating stem of a camming element is rigidly mounted on the frame and entraps the camming element. The camming element receives and engages the interengagable ends of a neck band, defining a loop. The loop embraces the wearer's neck and may be tightened thereabout by pulling down on the interengaged neck band ends relative to the camming element. The novel flanges promote a knot having a fuller shape, decrease material wear and deter the user from pulling the neck band sideways, jamming or damaging the interengaging structures of the neck band. A front member is mounted to and loops around the frame to resemble a tie knot.

2 Claims, 5 Drawing Sheets

NECKTIE

BACKGROUND OF THE INVENTION

1. Field of the Invention

This invention relates to neckties. More specifically, the present invention relates to a pre-fabricated necktie including a knot mandril or frame.

2. Description of the Prior Art

Traditionally, a necktie is constructed from fine cloth into a long, tapered strip having hemmed edges. One end, "wide end" hereinafter, is wider than the other end, "narrow end" hereinafter. A necktie wearer drapes the middle section about his neck and, selecting from a plurality of knot styles, secures the necktie around the neck, inside the collar of a shirt. Neckties are either a source of sartorial splendor or excruciating embarrassment. A well made necktie fashioned properly makes an excellent accent for a suit of clothes.

Whether or not aesthetically pleasing, many complaints have been lodged against neckties. The most prominent complaint centers on the inordinate amount of time users spend fashioning a tie day after day. Other complaints involve users' frustration associated with tying attractive and consistent knots. A need exists for a necktie that is easy to tie and assumes attractive and consistent knots.

Several types of neckties are described in the literature. For example, U.S. Pat. No. 3,898,698, issued Aug. 12, 1975 to David J. Byrd, describes a necktie. The apparatus includes a trapezoid-shaped frame having flanges extending rearwardly from the opposed non-parallel edges. The frame includes a plurality of throughbores for receiving thread. A cover and downwardly-extending front member are stitched to the frame via the throughbores. The operating stem of a camming element is fixed to the frame between the flanges. The camming element receives and engages the interengagable ends of a zippered neck band, defining a loop. The loop embraces the wearer's neck and may be tightened thereabout by pulling down on the interengaged neck band ends relative to the camming element.

U.S. Pat. No. 4,513,453, issued Apr. 30, 1985, to Jiann Chen et al., describes a pre-tied necktie. The apparatus includes a frame having a generally wedge-shaped front profile and a kidney-shaped top profile. The enclosed kidney shape is disposed only at the top portion of the frame. A tang extends downwardly from the frame, defining the point of the wedge. A generally M-shaped frame stretches across the top opening of the frame. The operating stem of a camming element attaches to the inside of the frame. The camming element receives and engages the interengagable ends of a zippered neck band, defining a loop. The loop embraces the wearer's neck and may be tightened thereabout by pulling down on the interengaged neck band ends relative to the camming element. A front member, resembling a conventional wide end, mounts onto the frame and is looped about the frame to appear like a tie knot.

U.S. Pat. No. 4,656,672, issued Apr. 14, 1987, to Martin Lands, describes a zipper necktie. The apparatus includes a frame having a generally wedge-shaped front profile and a kidney-shaped top profile. The enclosed kidney shape is disposed only at the top portion of the frame. A tang extends downwardly from the frame, defining the point of the wedge. The hooking member of the camming element is received in a slot in the tang and extends rearwardly. The camming element receives and engages the interengagable ends of a zippered neck band, defining a loop. The loop embraces the wearer's neck and may be tightened thereabout by pulling down on the interengaged neck band ends relative to the camming element. A front member, resembling a conventional wide end, mounts onto the frame and is looped about the frame to appear like a tie knot.

U.S. Pat. No. 4,710,982, issued Dec. 8, 1987, to Martin Lande, describes a zipper necktie. The apparatus includes a frame having a generally wedge-shaped front profile and a kidney-shaped top profile. The enclosed kidney shape is disposed only at the top portion of the frame. A tang extends downwardly from the frame, defining the point of the wedge. A camming element is received in the upper portion of the frame. The operating stem of the camming element is fixed to the tang. The camming element receives and engages the interengagable ends of a zippered neck band, defining a loop. The loop embraces the wearer's neck and may be tightened thereabout by pulling down on the interengaged neck band ends relative to the camming element. A front member, resembling a conventional wide end, mounts onto the front of the frame and is looped about the frame to appear like a tie knot.

U.S. Pat. No. 4,835,794, issued Jun. 6, 1989, to Jiann-Jong Chen et al., describes a preset necktie. A camming element having a generally pentagon shape receives and engages the interengagable ends of a zippered neck band, defining a loop. The loop embraces the wearer's neck and may be tightened thereabout by pulling down on the interengaged neck band ends relative to the camming element. The camming element is configured to pinch the interlocked ends and maintain the camming elements's position relative to the neck band. A frame having a generally wedge-shaped front profile and a kidney-shaped top profile mounts on the camming element. The enclosed kidney shape is disposed only at the top portion of the frame. A tang extends downwardly from the frame, defining the point of the wedge. A front member, resembling a conventional wide end, is looped about the frame to appear like a tie knot.

U.S. Pat. No. 5,048,127, issued Sep. 17, 1991, to Philip S. Yang, describes an interchangeable pre-tied necktie. The apparatus includes a fame having a generally wedge-shaped front profile and a split kidney-shaped top profile. The kidney shape is disposed only at the top portion of the frame. A tang extends downwardly from the frame, defining the point of the wedge. The operating stem of a camming element is captured by a loop extending rearwardly from the tang. A throughbore in the operating stem receives a boss extending rearwardly from the tang for retaining the operating stem in the loop. The camming element receives and engages the interengagable ends of a zippered neck band, defining a loop. The loop embraces the wearer's neck and may be tightened thereabout by pulling down on the interengaged neck band ends relative to the camming element. A front member, resembling a conventional wide end, is mounted onto the front of the frame and loops about the frame to appear like a tie knot.

U.S. Pat. No. 5,113,531, issued May 19, 1992, to Jacqueline Castro, describes a zippered decorative necktie. The apparatus includes a strip of material defining a loop. A camming element receives and engages the interengagable ends of the neck band. A bow tie mounts to the camming element.

U.S. Pat. No. 5,170,507, issued Dec. 15, 1992, to Gordon B. Langford, describes a necktie. The apparatus includes a frame having a V-shaped front profile. The eye of a camming element mounts at the vertex on the frame. The camming element receives and engages the interengagable ends of a zippered neck band, defining a loop. The loop embraces the wearer's neck and may be tightened thereabout by pulling down on the interengaged neck band ends relative to the camming element. A front member, resembling a conventional wide end, is mounted onto the front of the frame and loops about the frame to appear like a tie knot.

French Patent No. 1,178,162, published May 5, 1959, issued to Franz Huber, shows a zippered necktie. The apparatus includes an apparently hollow, Y-shaped frame. A cover and downwardly-extending front member are mounted on the frame. The operating stem of a camming element appears to be mounted within the frame. The camming element receives and engages the interengagable ends of a zippered neck band, defining a loop extending from each arm of the Y-shaped frame. The loop embraces the wearer's neck and may be tightened thereabout by pulling down on the interengaged neck band ends relative to the camming element.

Clearly, the above demonstrates a need for a necktie including a frame with flanges and integral camming element-front member fastening means.

None of the above references, taken alone or in combination, are seen as teaching or suggesting the presently claimed necktie.

SUMMARY OF THE INVENTION

The present invention overcomes the limitations of the above inventions by providing a frame with flanges and integral camming element-front member fastening means. The invention includes a frame having a generally wedge-shaped front profile. The frame includes flanges extending rearwardly and tapering downwardly. The flanges promote formation of a knot having a fuller shape than provided in the prior art frames which have no flanges. The flanges also decrease material wear that occurs when material is stretched across a sharp edge, as embodied in the prior art.

The operating stem of a camming element is rigidly mounted on the frame, entrapping the camming element. The camming element receives and engages the interengagable ends of a zippered neck band, defining a loop. The loop embraces the wearer's neck and may be tightened thereabout by pulling down on the interengaged neck band ends relative to the camming element. The frame flanges deter the user from pulling the neck band sideways and jamming or damaging the zipper.

The invention also includes a front member, resembling a conventional wide end of a tie. In one embodiment of the invention, the front member is mounted on the front, upper portion of the frame. In a second embodiment, the front member is mounted on the lower portion of the frame simultaneously with the camming element. The front member loops about the frame and resembles a tie knot.

In consideration of the above, an object of the invention is to provide necktie including a frame with flanges that deters material wear due to sharp frame edges.

Another object of the invention is to provide necktie including a frame with flanges that provides a knot having a full-bodied, aesthetically pleasing shape.

A further object of the invention is to provide necktie including a frame with flanges that deters sideways pulling of the neck band.

An additional object of the invention is to provide simultaneous fastening means for a camming element and front member.

Yet another object of the invention is to provide improved elements and arrangements thereof in an apparatus for the purposes described which is inexpensive, dependable and fully effective in accomplishing its intended purposes. These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 1:
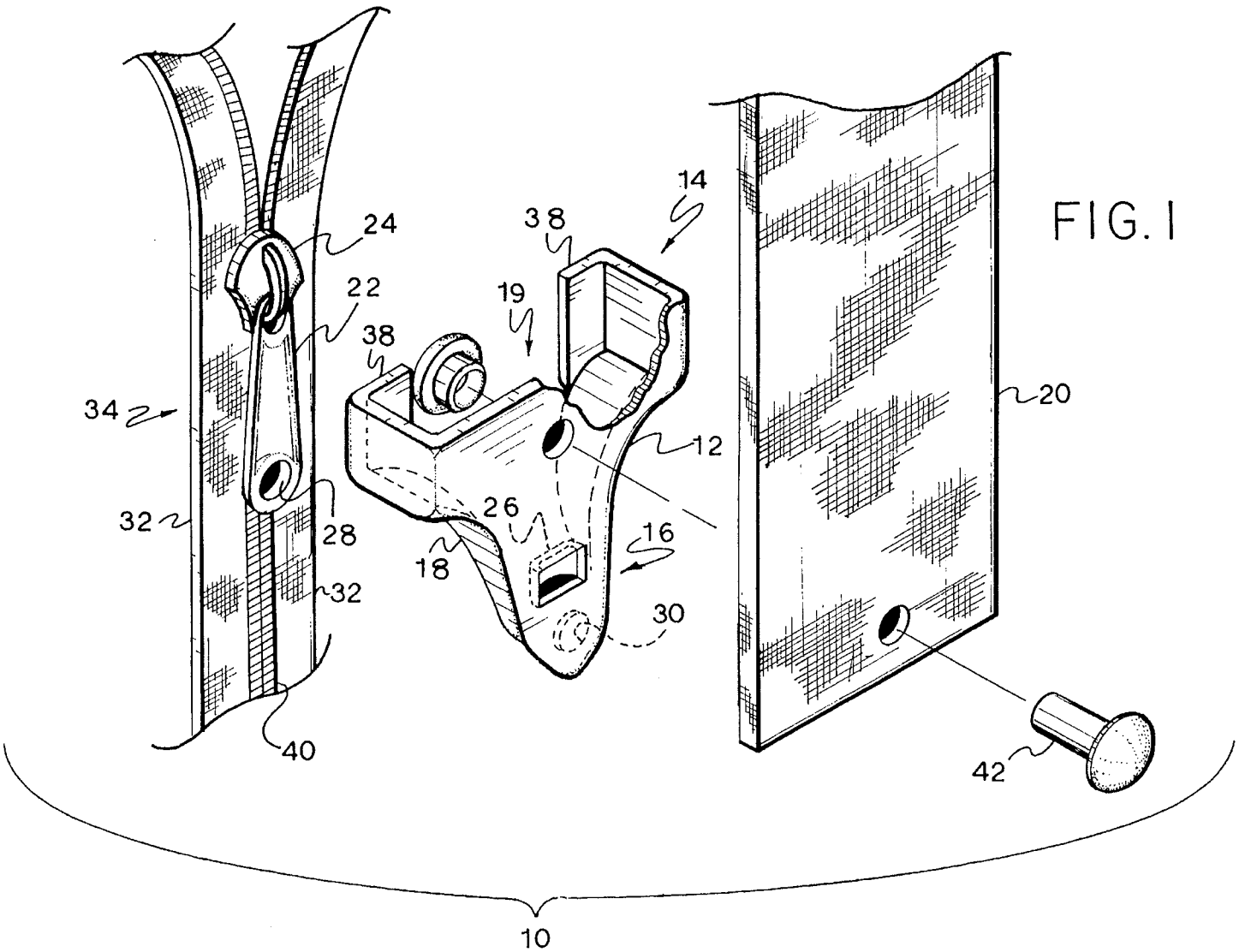
FIG. 1 is an exploded view of the frame, camming element, neck band and front member of the invention.
Figure 2:
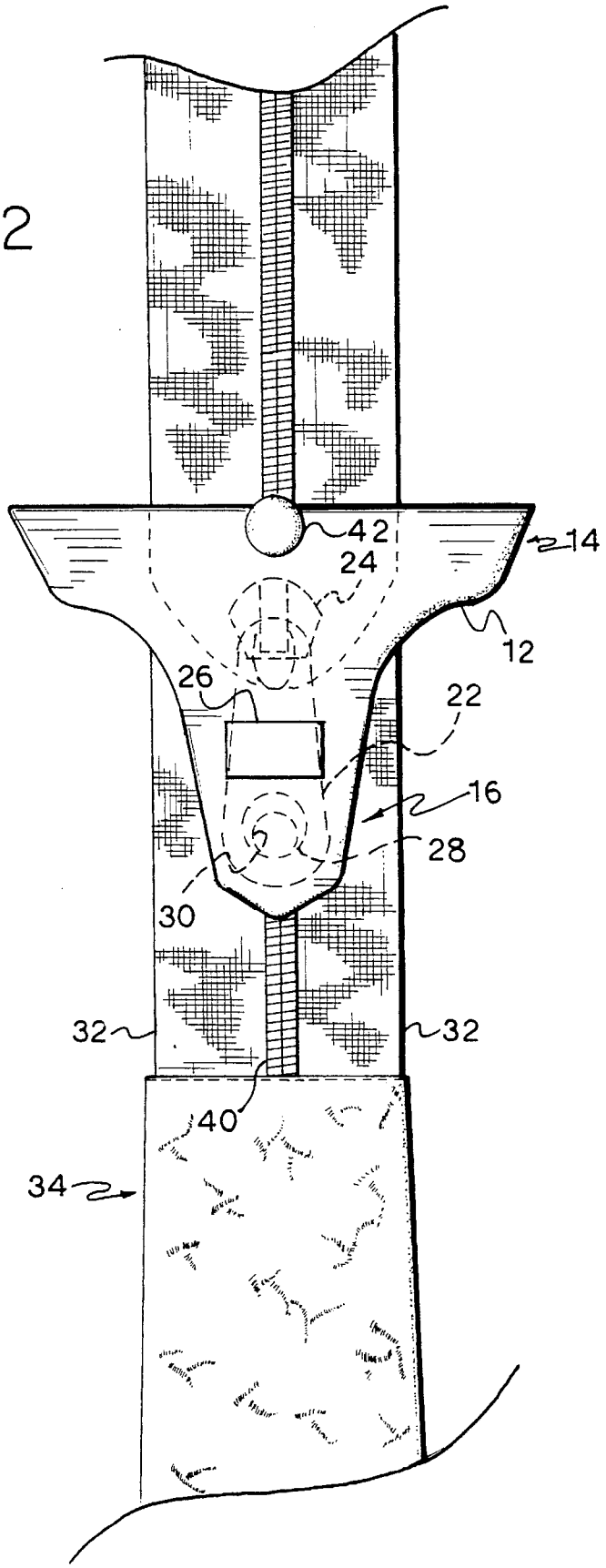
FIG. 2 is a front elevational view of the assembled frame, camming element and neck band of the invention.

Referring to FIGS. 1 and 2, a first embodiment 10 of the invention is shown including a frame 12 having an upper portion 14 and a lower portion 16. The frame 12 is shown being constructed from metal. However, the frame 12 may be constructed from any rugged material including, but not limited to: polyolefins, polystyrenes, copolymers containing the same; acrylonitrile/butadiene/styrenes copolymers, polyacrylates, polymethacrylates, phenolics or the like.

The frame 12 has a generally wedge-shaped front profile. Flanges 18 extend rearwardly from the frame 12, defining a trough 5 19. The flanges 18 are shown tapering from a predetermined maximum flange width to zero width at the lower portion 16 of the frame 12. However, the flange width may be constant or determined by any continuous function.

The flanges 18 represent a substantial departure from the prior art such as described in U.S. Pat. No. 5,048,127, discussed supra. The flanges 18 add width to the frame 12 that promotes a full-bodied knot appearance when the front member 20 is knotted thereabout, as discussed infra. The flanges 18 also provide for decreased material wear of the front member 20. Material draped over a sharp edge experiences more concentrated abrasion than material draped over a broad surface. The flanges 1S provide a broad surface that will dissipate abrasive encounters by the front member 20. This broad surface also provides the wearer with a larger, more tactually-friendly surface with which to grasp the frame when securing the invention about the neck.

The operating stem 22 of a camming element 24 is received in a horizontal loop 26 extending rearwardly from the frame 12, entrapping the camming element 24. The loop 26 is large enough to provide the user with ready access to the operating stem 22. A throughbore 28 in the operating stem 22 receives a boss 30 extending rearwardly from the frame 12. The boss 30 maintains the operating stem 22 within the loop 26. The camming element 24 is retained tightly against the frame 12 with minimal play.

The camming element 24 receives and engages the interengagable ends 32 of a neck band 34. Each end 32 includes mating zipper members. The neck band 34 defines a loop 36, as shown on FIG. 3, for encircling a wearer's neck (not shown). The loop 36 may be tightened about the wearer's neck (not shown) by pulling down on the ends 32 relative to the camming element 24.

The upper portion 14 of the frame 12 further includes flanges 38 extending inwardly from the rearward flanges 18 toward each other. The flanges 38 help to maintain the neck band 34 within the trough 19. The flanges 18 and 38 of the frame 12 deter the user from pulling the ends 32 of the neck band 34 sideways and jamming or damaging the zipper 40.

Figure 3:
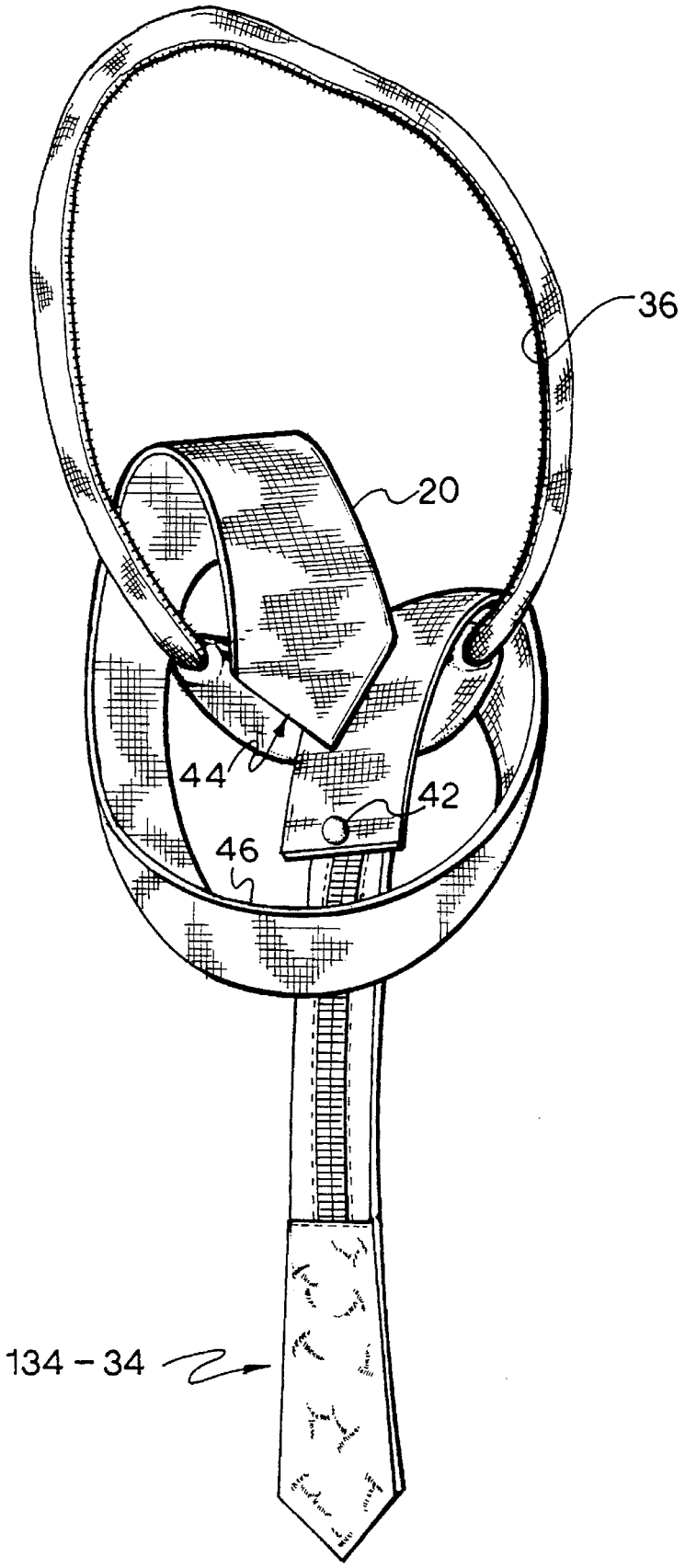
FIG. 3 is a front elevational view of the front member being formed into a knot about the frame and neck band.

Referring also to FIG. 3, the invention includes a front member 20. The front member 20 resembles a conventional wide end of a tie. The front member 20 may be mounted on the upper portion 14 of the frame 12 by a rivet 42. Any fastening means having equivalent characteristics will suffice.

Figure 4:
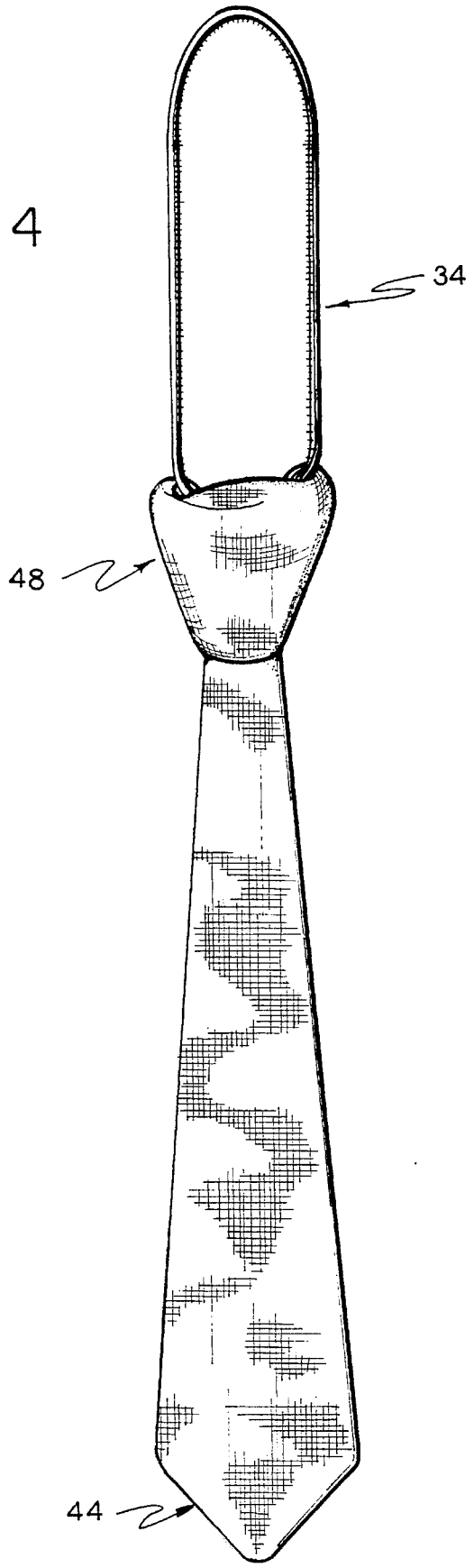
FIG. 4 is a front elevational view of the front member knotted about the frame and neck band.

Referring also to FIG. 4, the front member 20 is fashioned about the frame 12 and neck band 34 to resemble a tie knot. The distal end 44 of the front member 20 is pulled upwardly then back over the top of the frame 12. The end 44 is pulled downwardly and around the front of the ends 32 of the neck band 34 defining a front loop 46. The end 44 of the front member 20 is drawn upwardly behind the frame 12 then pulled forwardly over the top of the frame 12. Finally, the end 44 is pulled downwardly through the loop 46 and tightened sufficiently to form a crisp, compact knot 48.

Figure 5:
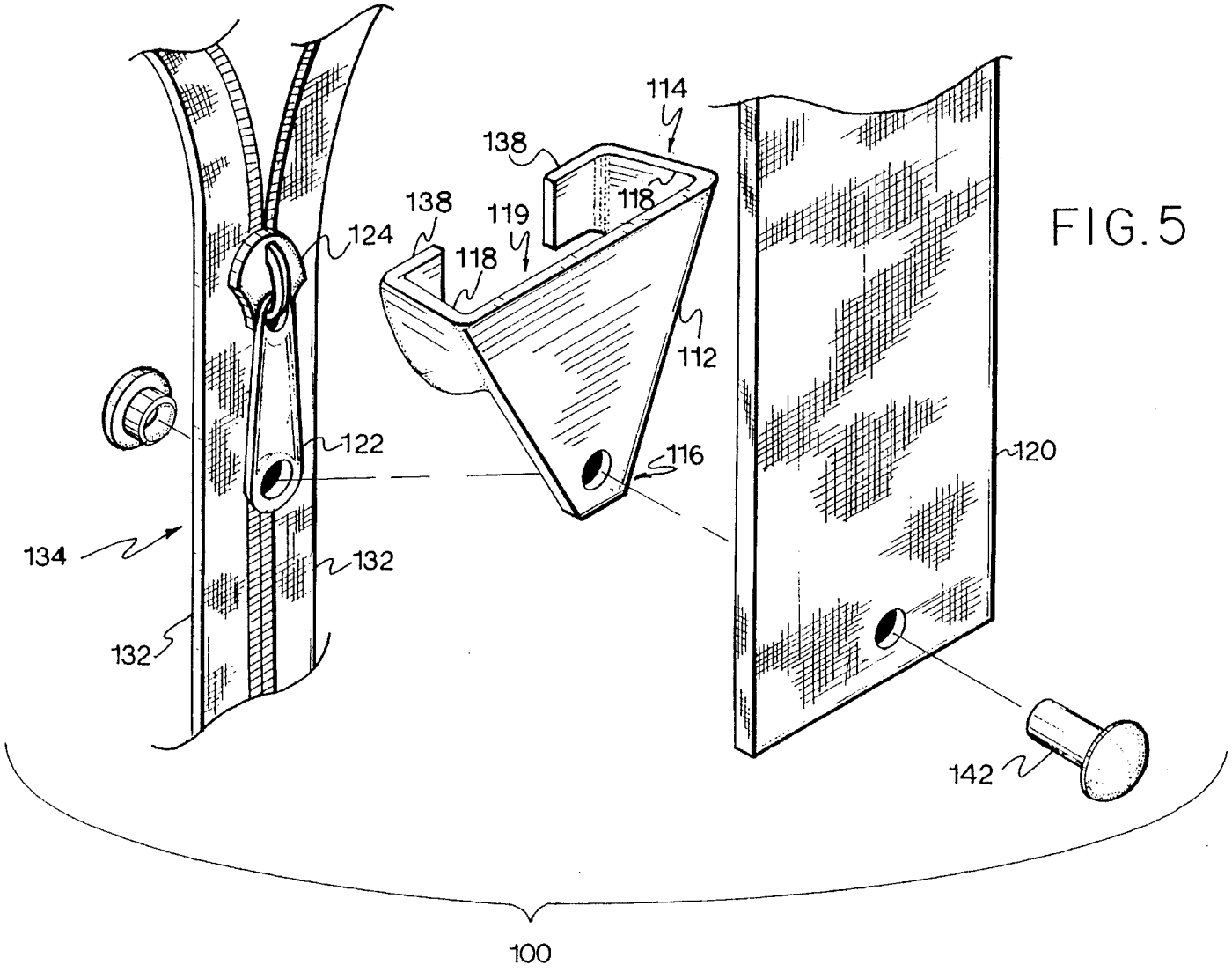
FIG. 5 is an exploded view of a second embodiment of the frame, camming element, neck band, front member and attachment means for both the camming element and front member of the invention.

Referring to FIG. 5, a second embodiment 100 of the invention is shown. The second embodiment includes a frame 112 having an upper portion 114 and a lower portion 116. The frame 112 has a generally wedge-shaped front profile. The frame 112 may have rearwardly extending flanges (not shown) as in the first embodiment 10.

The operating stem 122 of a camming element 124 is rigidly mounted to the frame 112 with a rivet 142 or fastening means having equivalent properties. As in the first embodiment 10, the camming element 124 receives and engages the interengagable ends 132 of a neck band 134.

The upper portion 114 of the frame 112 has rearwardly extending flanges 118 and flanges 138 extending inwardly therefrom toward each other. The flanges 118 and 138 define a trough 119 in which the neck band 134 is maintained.

As discussed above, a front member 120 is rigidly mounted on the lower portion 116 of the frame 112 also by the rivet 142. Simultaneous fastening of the camming element operating stem 122 and front member 120 represents a significant departure from the prior art. This radical improvement simplifies and reduces material costs of manufacturing. Fewer parts and manufacturing steps are necessary to carry out the invention. Additionally, molds for the frame 112 no longer require slides and cavities with critical tolerance demands.

Referring again to FIGS. 3 and 4, the front member 120 is fashioned about the frame 112 and neck band 134 into a knot shape in a similar fashion as the front member 20 in the first embodiment 10.

The present invention is not intended to be limited to the embodiments described above, but to encompass any and all embodiments within the scope of the following claims.

I claim:

1. A frame for supporting a prefabricated knot of a pre-tied necktie, the necktie having a wide front end and an adjustable neck band including a zippered loop, the loop having opposite sides adjustably zipped together by a zipper camming element, the camming element having a stem with a throughbore, said frame comprising:

a substantially planar wedge-shaped front surface having a narrow lower portion and a wide upper portion, the wide upper portion including an aperture for receiving a rivet to connect the wide front end of the tie to said frame, said wedge shaped front portion including opposing side edges;

two primary flanges disposed substantially perpendicular to said front surface, each of said primary flanges extending rearwardly from one of said side edges of said front surface, each of said primary flanges having a wide end adjacent said wide upper portion of said front surface, said primary flanges tapering from a maximum width at said wide end to a zero width adjacent said narrow lower portion of said front surface;

two secondary flanges connected to said wide ends of said primary flanges, said secondary flanges extending inwardly toward each other substantially parallel to said front surface to define a trough for retaining the neck band;

a horizontal loop extending rearwardly from said lower portion of said front surface for holding the stem of the zipper camming element; and a boss extending rearwardly from said lower portion of said front surface for engaging the throughbore of the stem of the zipper camming element.

2. A pre-tied adjustable necktie comprising:

wide fabric front portion;

an adjustable neck band loop having opposite sides, each side including mating zipper members, and a zipper camming element connecting said zipper members and slidable thereon for adjusting the size of said neck band loop, said camming element including a stem having a throughbore therethrough; and a knot supporting frame including, a substantially planar wedge-shaped front surface having a narrow lower portion, and a wide upper portion, the wide upper portion including an aperture, said wedge shaped front portion including opposing side edges, a rivet disposed in the aperture, said rivet connecting the wide fabric front portion to said knot supporting frame, two primary flanges disposed substantially perpendicular to said front surface, each of said primary flanges extending rearwardly from one of said side edges of said front surface, each of said primary flanges having a wide end adjacent said wide upper portion of said front surface, said primary flanges tapering from a maximum width at said wide end to a zero width adjacent said narrow lower portion of said front surface, two secondary flanges connected to said wide ends of said primary flanges, said secondary flanges extending inwardly toward each other substantially parallel to said front surface to define a trough for retaining said neck band, a horizontal loop extending rearwardly from said lower portion of said front surface said horizontal loop encircling said stem of said zipper camming element, and a boss extending rearwardly from said lower portion of said front surface, said boss engaging the throughbore of said stem of said zipper camming element.

* * * * *